US011799185B1

(12) United States Patent
Ghannam et al.

(10) Patent No.: US 11,799,185 B1
(45) Date of Patent: Oct. 24, 2023

(54) MULTI-PURPOSE USE OF METAL FOAM IN A VEHICLE

(71) Applicant: Ford Global Technologies, LLC, Dearborn, MI (US)

(72) Inventors: Mahmoud Yousef Ghannam, Canton, MI (US); Ali Attaran, Lasalle (CA); Ming Liang, Canton, MI (US); Michael Dupuis, Macomb, MI (US); John Locke, Waterford, MI (US); Deepa Ramaswamy, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/659,196

(22) Filed: Apr. 14, 2022

(51) Int. Cl.
*H01Q 1/32* (2006.01)
*H01Q 1/02* (2006.01)
*H01Q 1/52* (2006.01)

(52) U.S. Cl.
CPC ..... *H01Q 1/02* (2013.01); *H01Q 1/3208* (2013.01); *H01Q 1/52* (2013.01)

(58) Field of Classification Search
CPC .. H01Q 1/24; H01Q 1/02; H01Q 1/32; H01Q 1/3208; H01Q 1/52
See application file for complete search history.

(56) References Cited

U.S. PATENT DOCUMENTS

2022/0322516 A1* 10/2022 Kim ..... H01Q 9/0407

FOREIGN PATENT DOCUMENTS

| | | | | |
|---|---|---|---|---|
| CN | 106540335 A | * | 3/2017 | ..... A61F 2/28 |
| CN | 109659703 A | | 4/2019 | |
| JP | 5967938 B2 | * | 8/2016 | ..... H01Q 1/28 |
| KR | 20150056197 A | | 5/2015 | |
| WO | 200120722 A1 | | 3/2001 | |
| WO | 2020219060 A1 | | 10/2020 | |

OTHER PUBLICATIONS

J. Anguera et al., Metallized Foams for Antenna Design: Application to Fractal-Shaped Sierpinski-Carpet Monopole, Progress in Electomagnetics Research, PIER 104, 2010, 239-251.

* cited by examiner

*Primary Examiner* — Tho G Phan
(74) *Attorney, Agent, or Firm* — Frank Lollo; Eversheds Sutherland (US) LLP

(57) ABSTRACT

The disclosure is generally directed to a metal foam element configured to provide a multi-purpose functionality to an electrical device in a vehicle. An example apparatus in a vehicle includes a module that houses an electrical device. A metal foam element is attached to the module in a configuration whereby the metal foam element provides a multi-purpose functionality that includes a heat dissipation functionality and an antenna functionality. In an example implementation, the metal foam element is attached to the module in the form of a sheet that is dimensioned to operate as a patch antenna for transmitting and/or receiving a wireless signal associated with the electrical device and to provide a heat dissipation functionality for dissipating heat produced by the electrical device.

18 Claims, 7 Drawing Sheets

MULTI-PURPOSE USE OF METAL FOAM IN A VEHICLE

BACKGROUND

Motor vehicles typically contain a number of parts made of metal because metal provides various advantages such as strength and durability. Motor vehicles also include electronic components that generate heat when in operation. It is desirable to dissipate the generated heat because heat can be detrimental to electronic components. Conventional solutions for heat dissipation include the use of metal heat sinks and heat radiating fins. Metal heat sinks and heat radiating fins may be inadequate to cool some types of electronic components, thereby necessitating the use of more expensive liquid-based cooling structures. It is therefore desirable to replace or supplement metal heat sinks, heat radiating fins, and liquid-based cooling structures in vehicles with alternative elements that may offer various advantages.

BRIEF DESCRIPTION OF THE DRAWINGS

A detailed description is set forth below with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
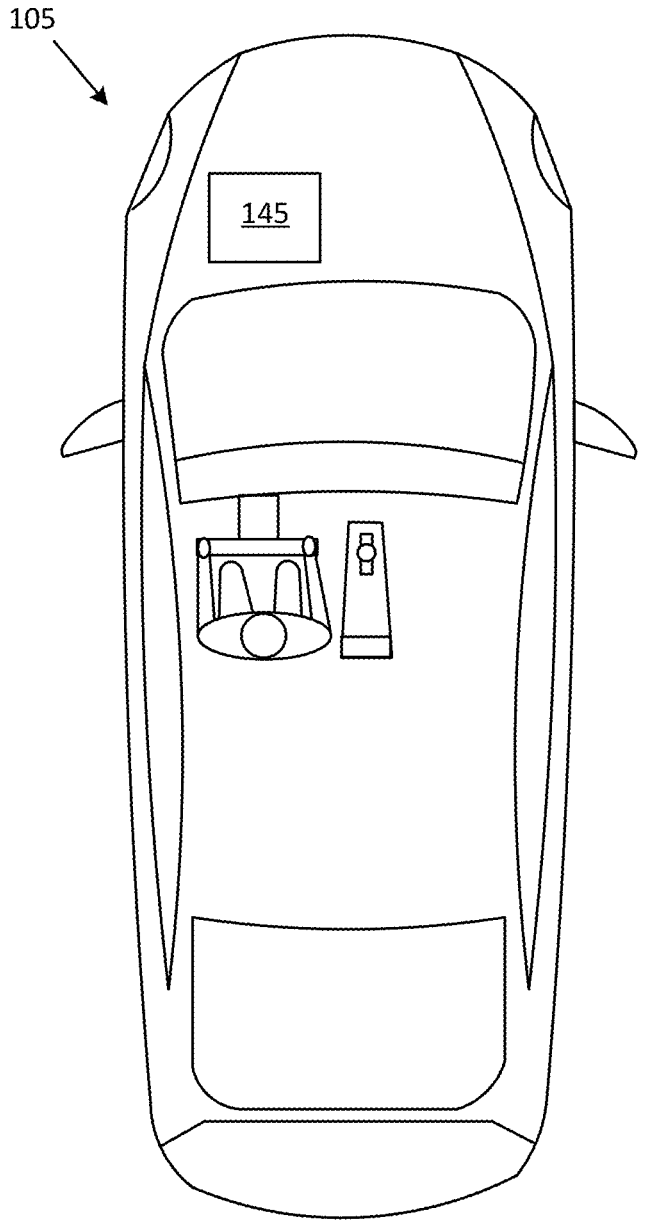
FIG. 1 shows an example vehicle that includes an electrical device that generates heat.

In terms of a general overview, embodiments described in this disclosure are generally directed to a metal foam element configured to provide a multi-purpose functionality to an electrical device in a vehicle. An example apparatus in a vehicle includes a module that houses an electrical device. A metal foam element is attached to the module in a configuration whereby the metal foam element provides a multi-purpose functionality that includes a heat dissipation functionality and an antenna functionality. In an example implementation, the metal foam element is attached to the module in the form of a sheet that is dimensioned to operate as a patch antenna for transmitting and/or receiving a wireless signal associated with the electrical device and to provide a heat dissipation functionality for dissipating heat produced by the electrical device.

Illustrative Embodiments

The disclosure will be described more fully hereinafter with reference to the accompanying drawings, in which example embodiments of the disclosure are shown. This disclosure may, however, be embodied in many different forms and should not be construed as limited to the example embodiments set forth herein. It will be apparent to persons skilled in the relevant art that various changes in form and detail can be made to various embodiments without departing from the spirit and scope of the present disclosure. Thus, the breadth and scope of the present disclosure should not be limited by any of the above-described example embodiments but should be defined only in accordance with the following claims and their equivalents. The description below has been presented for the purposes of illustration and is not intended to be exhaustive or to be limited to the precise form disclosed. It should be understood that alternate implementations may be used in any combination desired to form additional hybrid implementations of the present disclosure. For example, any of the functionality described with respect to a particular device or component may be performed by another device or component. Furthermore, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments.

Certain words and phrases are used herein solely for convenience and such words and terms should be interpreted as referring to various objects and actions that are generally understood in various forms and equivalencies by persons of ordinary skill in the art. For example, it must be understood that the phrase "electrical device" as used herein can refer to any of various types of electrical gadgets, devices, components, electrical parts, etc. (such as for example a solid-state switch, a power transistor, and a relay, each of which may operate by use of vehicle battery voltage of 12 volts), modules that include electrical devices (such as, for example, an engine control unit (ECU) a brake control module), and also "electronic" components. As used herein an "electronic" component, "electronic" device, and/or "electronic" circuit generally refers to components that are operated at voltage levels below 12 volts (5 volts or 3.3 volts, for example). At least some of these components can be "wireless" components. Wireless components can perform operations involving wireless signals that are transmitted/received via an antenna. A few examples of wireless components include a radio-frequency (RF) transmitter chip/circuit, an RF receiver chip/circuit, an RF transceiver chip/circuit. The phrase "electrically coupled" indicates that an electrical signal is propagated through a transmission medium. In some cases, the electrical signal may be propagated through a wire. In some other cases, the electrical signal may be propagated wirelessly. The word "attached" as used herein pertains to one object that is placed in contact with another object, either directly or via an intermediary material. For example, in one case, a metal foam element that is used as a heat sink may be placed in direct contact with a metal object (a metal enclosure, for example). In another case, a heat sink compound may be applied between a metal foam element and a surface of a metal object. In yet another case, an adhesive material may be used to affix a metal foam element upon a metal object. The word "enclosure" may be interchangeably used herein in some contexts with the word "module."

The word "vehicle" as used in this disclosure can pertain to any one of various types of vehicles such as cars, vans, sports utility vehicles, trucks, electric vehicles, gasoline vehicles, hybrid vehicles, driver-operated vehicles, and autonomous vehicles. More generally, the systems and methods disclosed herein are applicable to various types of vehicles that are defined by the Society of Automotive Engineers (SAE) as incorporating six levels of driving automation ranging from Level 0 (fully manual) to Level 5 (fully autonomous).

It must be understood that words such as "implementation," "application," "scenario," "case," and "situation" as used herein are an abbreviated version of the phrase "In an example ("implementation," "application," "scenario," "case," "approach," and "situation") in accordance with the disclosure." It must also be understood that the word "example" as used herein is intended to be non-exclusionary and non-limiting in nature.

FIG. 1 shows an example vehicle 105 that includes an electrical device 145 containing one or more mechanical, electrical, and/or electronic components based on the functionality of the electrical device 145. For example, in one case, the electrical device 145 can be an engine control unit that controls various functions of an engine of the vehicle 105. In another case, the electrical device 145 can be an electronic control unit that performs various functions in the vehicle 105 such as, for example, fuel injection, cabin climate control, controlled braking, suspension adjustment, and emergency operations related to accidents. In some cases, the electrical device 145 can be any of an engine control module, a brake control module, a transmission control module, a telematic control module, and a suspension control module. The engine control module may receive signals from various types of sensors provided in the vehicle 105 and use the signals for controlling a fuel injection system and an ignition system, for example. The brake control system can be an antilock braking system that executes efficient braking procedures. The transmission control module can execute various gear shifting operations in accordance with factors such as speed and road gradient. The telematic control module can carry out various operations associated with, for example, satellite navigation (GPS navigation, for example), network connectivity (Internet access, for example), and phone connectivity (a Bluetooth® connection, for example). The suspension control module executes operations associated with a suspension system of the vehicle 105 such as, for example, modifying a setting of the suspension system in accordance with a terrain upon which the vehicle 105 is moving.

In some cases, the electrical device 145 can include an enclosure that houses any of the various example mechanical, electrical, and/or electronic components such as those described above. The enclosure may be made of any of various types of materials such as, for example, plastics, composites, metals, and metal alloys (aluminum, magnesium, etc.). The selection of the material may be based on various factors such as, for example, weight, ruggedness, space availability, and heat dissipation.

Plastics and composites offer some benefits in terms of weight but may not be optimal for dissipating heat generated by the electrical devices. Metals may offer some advantages in terms of ruggedness and heat dissipation but may suffer from weight related issues. In some cases, heat dissipation via a metal enclosure may be inadequate such as, for example, in the case of a power amplifier. The heat dissipation issue may be addressed to some degree by providing metal cooling fins, air circulation (fans), and liquid cooling (coolant). However, it is desirable to provide solutions that address certain shortcomings that are associated with these types of cooling elements.

Consequently, some of these shortcomings may be addressed by use of metal foam in accordance with disclosure. Metal foam can be generally described as a metal (such as aluminum, for example) that has a porous cellular structure. The porous cellular structure occupies most of the space in any given volume of metal foam, such as, for example, 75% to 95% of any given volume. The metal portion occupies the remaining 5% to 25% of the volume. The high porosity offers several benefits such as, for example, an ability to conduct heat via convection. The metal portion complements the convection heat property of the pores by providing an ability to conduct heat via conduction. The combination of heat transfer via convection and conduction may be exploited in accordance with the invention to dissipate heat present in a body portion of the electrical device 145 as a result of heat generated in the electrical device 145. The metal foam material offers additional advantages as a result of electrical conductivity characteristics of the metal portion of the metal foam. The various advantages provided by metal foam may be advantageously used in improving some aspects of the electrical device 145.

In one embodiment in accordance with the disclosure, the heat dissipation property of metal foam may be exploited for dissipating heat generated in the electrical device 145. This may be done by partially, or completely covering the electrical device 145 with metal foam material. The metal foam material can dissipate heat by conduction as well as convection and can be lighter in weight than a metal heat sink. Covering the electrical device 145 with metal foam can be carried out in several ways. In one approach, a sheet of a metal foam element is attached to an external surface of the electrical device 145. Additional sheets can be attached to one or more other external surfaces of the electrical device 145. The material of the body of the electrical device 145, which can be metal, remains unchanged, thereby providing an advantage in terms of offering an ability to retrofit some types of electrical devices that are already present in a manufactured vehicle.

In another embodiment in accordance with the disclosure, the electrical device 145 can be manufactured by replacing the metal material with metal foam. In this approach, the enclosure portion of the electrical device 145 is made of metal foam and no additional heat sinking may be needed in at least some applications. The weight of the electrical device 145 when made of metal foam is less than that of a similar module made of metal.

The metal foam structures described above offer not only advantages associated with heat dissipation and weight but other advantages that may be associated with the electrical conductivity properties of metal foam. Further details pertaining to this aspect are provided below.

Figure 2:
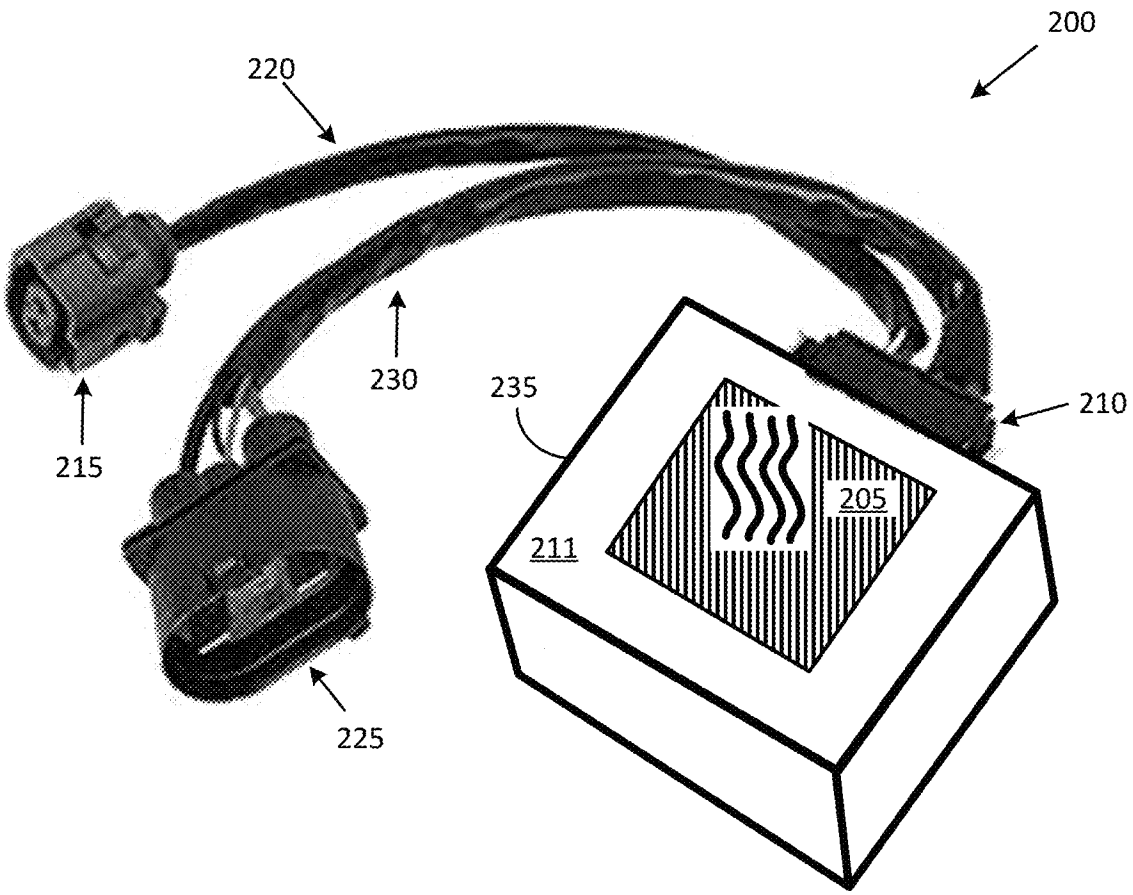
FIG. 2 shows a metal foam element attached to an example electrical device in a vehicle, the metal foam element providing a first functionality in accordance with an embodiment of the disclosure.

FIG. 2 shows a metal foam element 205 attached to an electrical device 200 in accordance with a first embodiment of the disclosure. The electrical device 200 constitutes one specific example of the electrical device 145 described above. The electrical device 200, can be any one of various modules such as, for example, an electronics control unit, an engine control module, a brake control module, a transmission control module, or a telematic control module. In this example implementation, the electrical device 200 includes an enclosure 235 that may house an electronic circuit. The electronic circuit, which can be provided in the form of a printed circuit board assembly (PCBA), for example, can include a component that generates heat such as, for example, a power transistor or a power supply module.

The enclosure 235 can include a connector 210. A wire assembly 220 and a wire assembly 230 are electrically attached to the connector 210. The wire assembly 220 includes a connector 215 and the wire assembly 230 includes a connector 225. The electrical device 200 may be mounted upon a chassis of the vehicle 105 such as, for example, upon a wall portion inside an engine compartment of the vehicle 105. The connector 215 and connector 225 may be mated with other connectors (not shown) that may be a part of a vehicle wiring harness. Power from a battery of the vehicle 105 may be conveyed to the electrical device 200 via one or both of the wire assemblies. Various types of electrical signals may be propagated in one or both directions via the wire assembly 220 and/or the wire assembly 230.

The metal foam element 205 generally provides a multipurpose functionality that can include a heat dissipation functionality, an antenna functionality, and a radio-frequency interference (RFI) shielding functionality. In this example implementation, the metal foam element 205 provides a heat dissipation functionality for dissipating heat generated by one or more components contained inside the enclosure 235. More particularly, the metal foam element 205 is provided in the form of a metal foam sheet that is attached to an external surface 211 of the electrical device 200. The external surface 211 is a planar surface in this example, but the metal foam sheet may be applied to other non-planar surfaces as well. The heat generated by a component (power transistor, power supply, etc.) located inside the enclosure 235 may be transferred to the external surface 211 in several ways such as, for example, via heat conduction (when the component is mounted upon an inner surface of the enclosure 235) or via heat radiation (when the component is a part of a PCBA contained inside the enclosure 235).

The heat that is transferred to the external surface 211 of the electrical device 200 can be dissipated by the metal foam sheet in two ways—via heat conduction through a metal content of the metal foam sheet and via heat convection through pores of the metal foam sheet.

Figure 3:
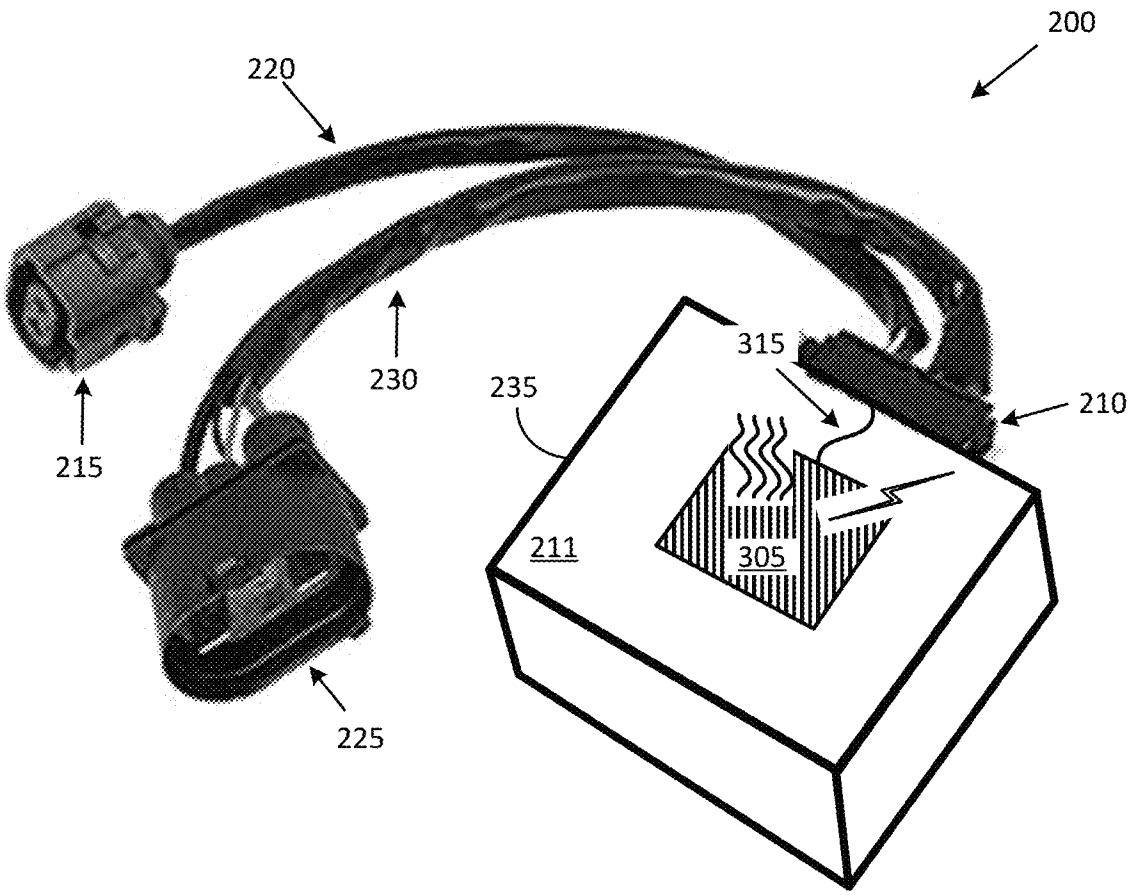
FIG. 3 shows a metal foam element attached to an example electrical device in a vehicle, the metal foam element providing a multi-purpose functionality in accordance with an embodiment of the disclosure.

FIG. 3 shows a metal foam element 305 attached to the electrical device 200 in accordance with a second embodiment of the disclosure. In this example implementation, the metal foam element 205 provides a heat dissipation functionality for dissipating heat generated by one or more components contained inside the enclosure 235 and also provides an antenna functionality for propagating wireless signals into, and/or out of, one or more components contained inside the enclosure 235.

In the illustrated example configuration, the metal foam element 305 is provided as a metal foam sheet that is attached to the external surface 211 of the electrical device 200 and dissipates heat in the manner described above with reference to the metal foam element 205. The additional functionality offered by the metal foam element 305 is provided by configuring the metal foam element 305 to operate as an antenna. More particularly, the metal foam element 305 is electrically coupled via an electrical conductor 315 (a wire, for example) to a wireless communications device located inside the enclosure 235 (RF receiver, RF transmitter, RF transceiver, etc.). In an example implementation, a size of the metal foam element 305 is selected to configure the metal foam element 305 as a patch antenna that is operable over a desired range of wireless frequencies. In the case of a patch antenna having a rectangular profile, the size can include parameters such as a width dimension and a length dimension. In the case of patch antenna having a square the size can include a surface area.

In an example application, the metal foam element 305 may be configured to operate as a patch antenna for a cellular-vehicle-to-everything (CV2X) transmitter operating at 5.9 GHz. More particularly, the metal foam element 305 may have a footprint (area-wise) that is substantially similar to an equivalent patch antenna made of metal and also offers electrical operating characteristics (antenna gain, return loss, etc.) that are comparable to those of the equivalent patch antenna made of metal. However, the metal foam element 305 provides better heat dissipation than the equivalent patch antenna made of metal. Improved heat dissipation allows the CV2X transmitter to operate more efficiently such as, for example, allows a power amplifier to provide a more linear predictable behavior with less drift over time.

In another example implementation, the metal foam element 305 may have a shape other than a rectangular or square shape such as, for example, a multi-linear shape, a multi-segmented shape, a curved shape, a helical shape, and/or a concentric shape. One or more of these shapes can include a microwave strip line and/or a microstrip whose dimensions are selected on the basis of propagating wireless signals having a desired frequency, a desired wavelength, and/or a desired bandwidth.

Figure 4:
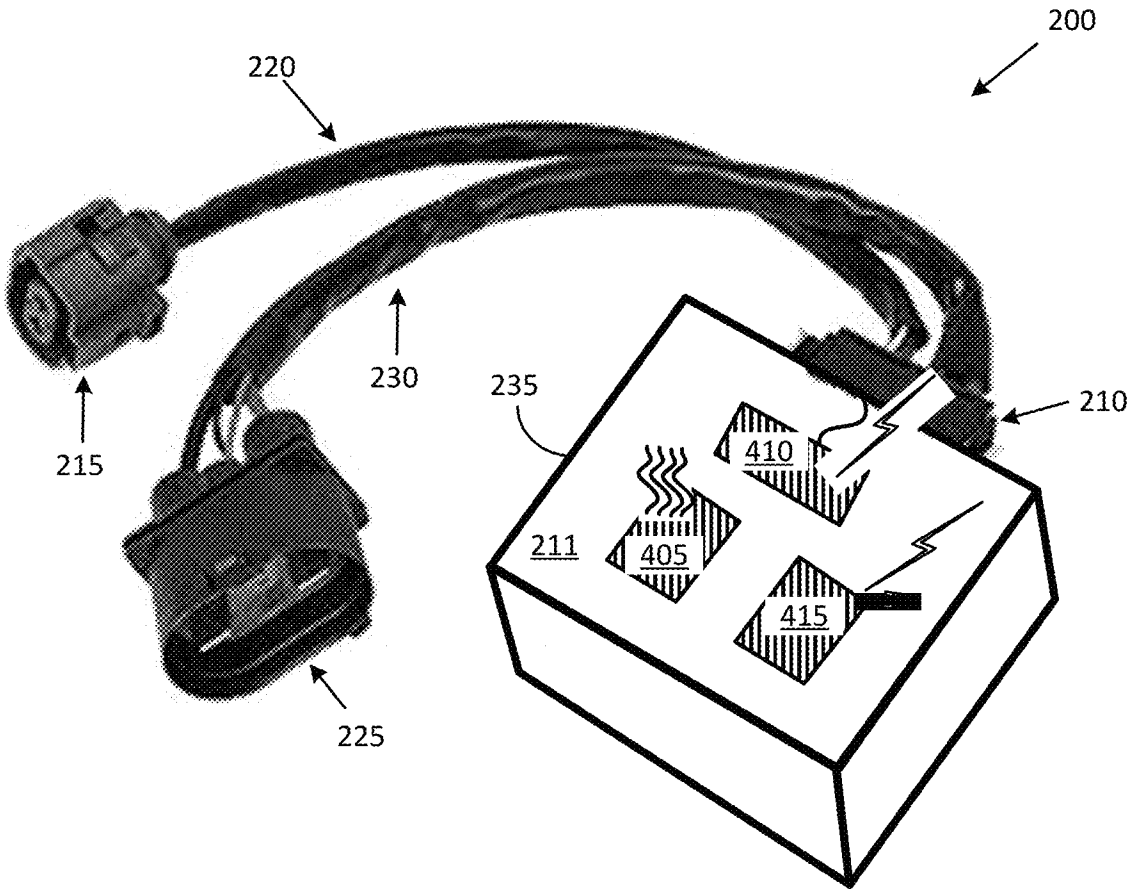
FIG. 4 shows multiple metal foam elements attached to an example electrical device in a vehicle, the metal foam element providing another multi-purpose functionality in accordance with an embodiment of the disclosure.

FIG. 4 shows multiple metal foam elements attached to the electrical device 200 in accordance with a third embodiment of the disclosure. In this example implementation, the multiple metal foam elements include a metal foam element 405, a metal foam element 410, and a metal foam element 415.

The metal foam element 405 provides a heat dissipation functionality similar to that described above with respect to the metal foam element 205 illustrated in FIG. 2. The metal foam element 410 provides an antenna functionality similar to that described above with respect to the metal foam element 305 illustrated in FIG. 3. The metal foam element 415 provides a radio-frequency interference (RFI) shielding functionality. The RFI functionality protects electronic components against radio-frequency interference that can have adverse effects upon the electronic components in some cases.

The multiple metal foam elements attached to the electrical device 200 that is illustrated in FIG. 4 are all located upon one surface of the electrical device 200. In other embodiments, at least one of the metal foam elements can be mounted on other external surfaces of the electrical device 200. Thus, in an example implementation, the metal foam element 405 may be attached to an obverse surface of the electrical device 200 and the metal foam element 410 and the metal foam element 415 may be attached to a reverse surface of the electrical device 200. One or more of the multiple metal foam elements may be attached to various other external surfaces of electrical devices having form factors that are different than that of the electrical device 200.

In yet some other embodiments, at least one of the metal foam elements can be mounted on an internal surface of the electrical device 200. For example, the metal foam element 415 that provides an RFI shielding functionality may be attached to an internal surface of the enclosure 235 or may be attached to a surface of an electronic component located inside the enclosure 235.

Figure 5:
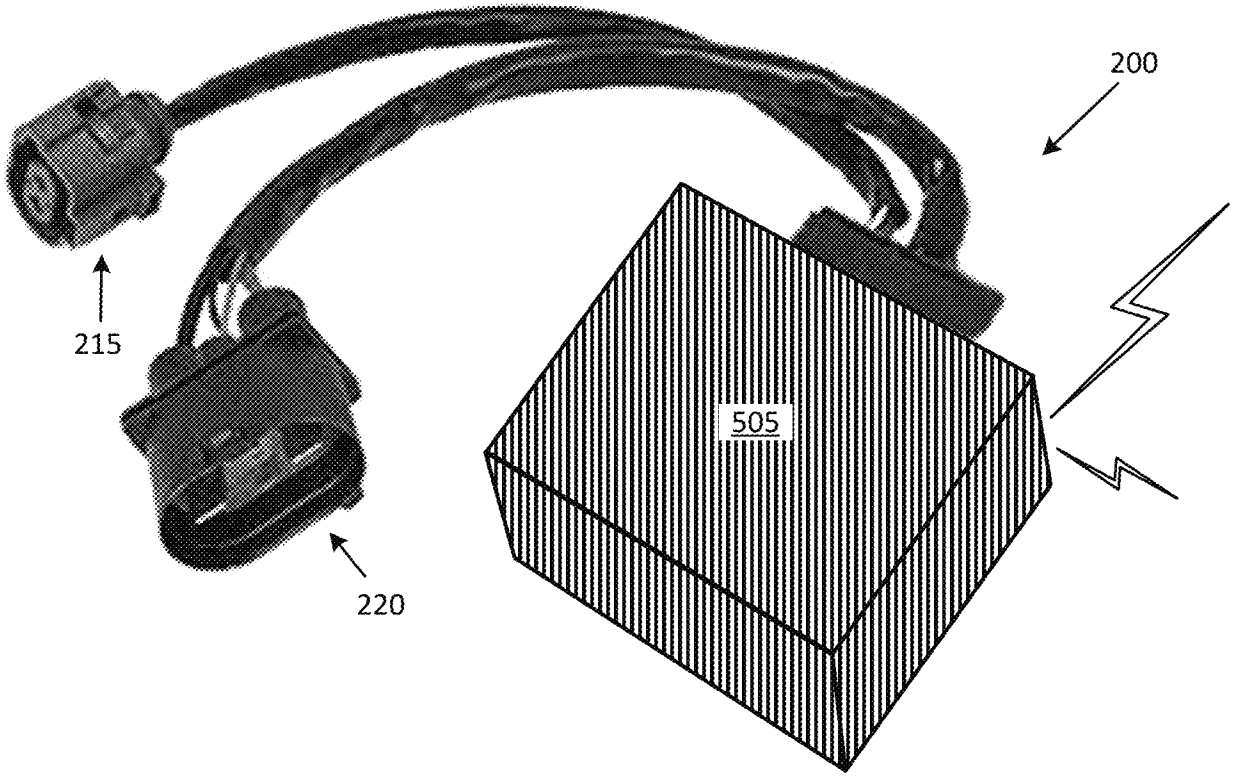
FIG. 5 shows a metal foam enclosure that provides a radio-frequency shielding functionality in accordance with an embodiment of the disclosure.

FIG. 5 shows a metal foam enclosure 505 that provides a radio-frequency shielding functionality in accordance with an embodiment of the disclosure. In this example implementation, the metal foam enclosure 505 is provided in the form of a box that encases the electrical device 200 described above. In another example implementation, the metal foam enclosure 505 may be provided around any type of electrical device that is either susceptible to radio-frequency interference and/or that generates radio-frequency interference.

The metal foam enclosure 505 operates as a Faraday cage that can be used to prevent radio-frequency interference from external sources from adversely affecting the electrical device 200. In some applications, the metal foam enclosure 505 operates as a Faraday cage that can be used to prevent or inhibit radio-frequency interference that may be generated by the electrical device 200 from adversely affecting other components located outside the electrical device 200.

The metal foam material of the metal foam enclosure 505 provides a multi-purpose functionality by operating as an RFI shield as well as a heat sink for dissipating heat generated by the electrical device 200. The metal foam material of the metal foam enclosure 505 further offers a weight reduction in comparison to a weight of a metal enclosure. The reduction in weight is desirable particularly in vehicle applications due to factors such as improved gas mileage and speed.

Figure 6:
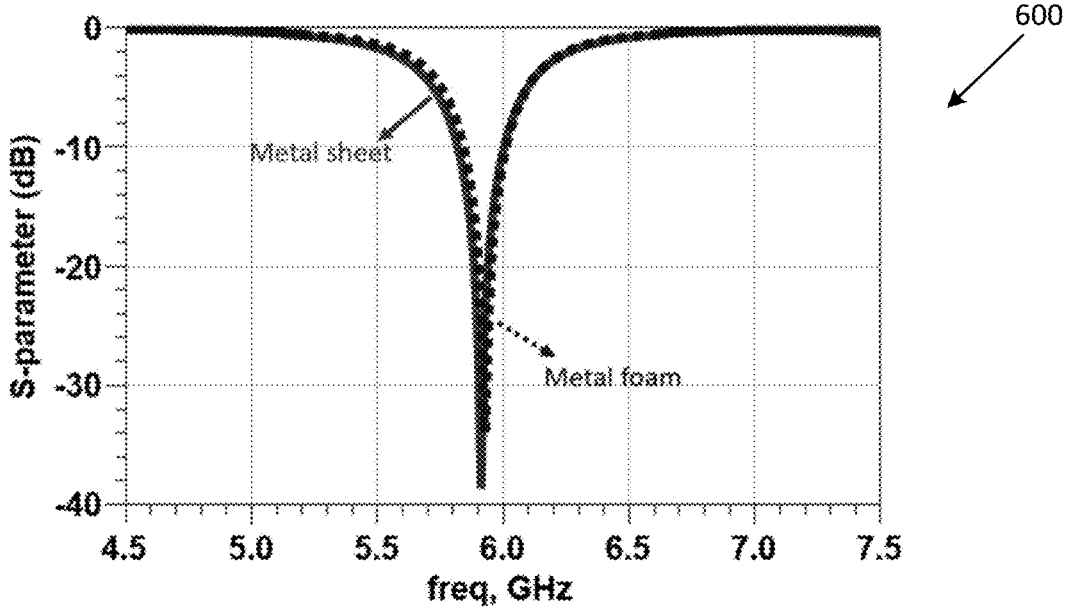
FIG. 6 shows a graph that provides return loss information associated with a metal foam element configured as a patch antenna in accordance with the disclosure.

FIG. 6 shows a graph 600 that provides return loss information associated with a metal foam element configured as a patch antenna in accordance with the disclosure. More particularly, the graph 600 pertains to a metal foam element configured as a patch antenna for a cellular-vehicle-to-everything (CV2X) transmitter operating at 5.9 GHz.

Figure 7:
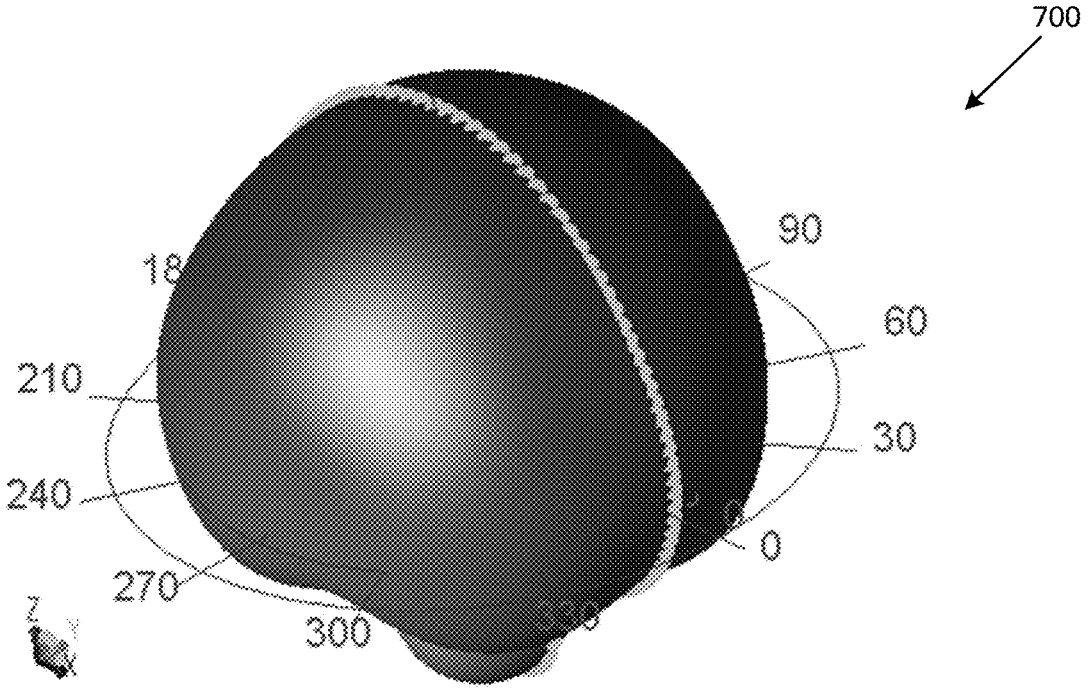
FIG. 7 shows a three-dimensional patch antenna pattern associated with a metal foam element configured as a patch antenna in accordance with the disclosure.

FIG. 7 shows a three-dimensional patch antenna pattern 700 that may be associated with a metal foam element configured as a patch antenna for a cellular-vehicle-to-everything (CV2X) transmitter operating at 5.9 GHz.

Figure 8:
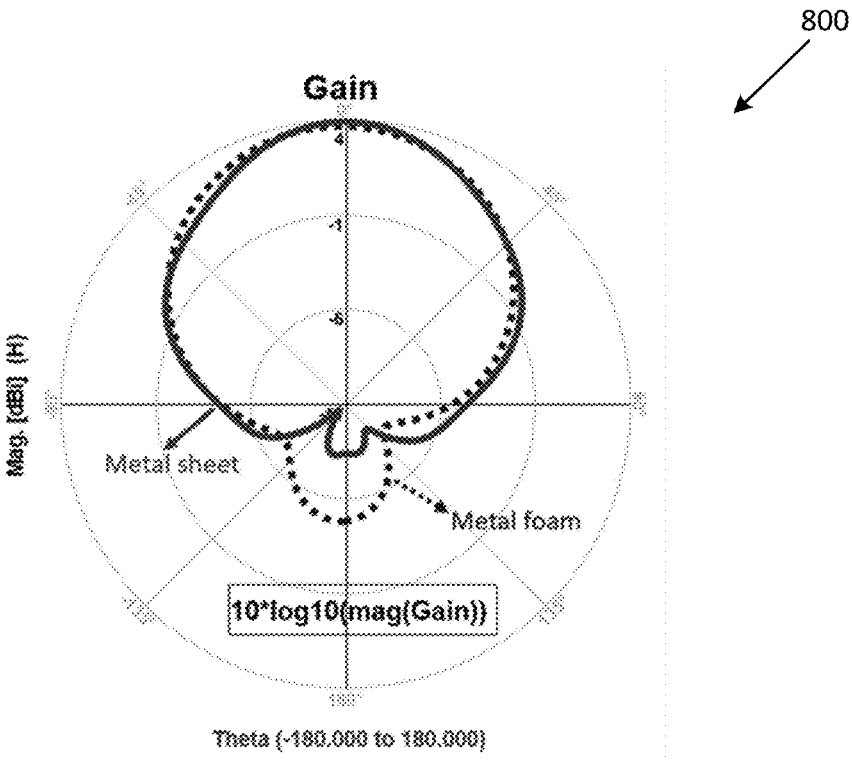
FIG. 8 shows an antenna gain diagram that may be associated with a metal foam element configured as a patch antenna in accordance with the disclosure.

FIG. 8 shows an antenna gain diagram 800 that may be associated with a metal foam element configured as a patch antenna for a cellular-vehicle-to-everything (CV2X) transmitter operating at 5.9 GHz.

Figure 9:
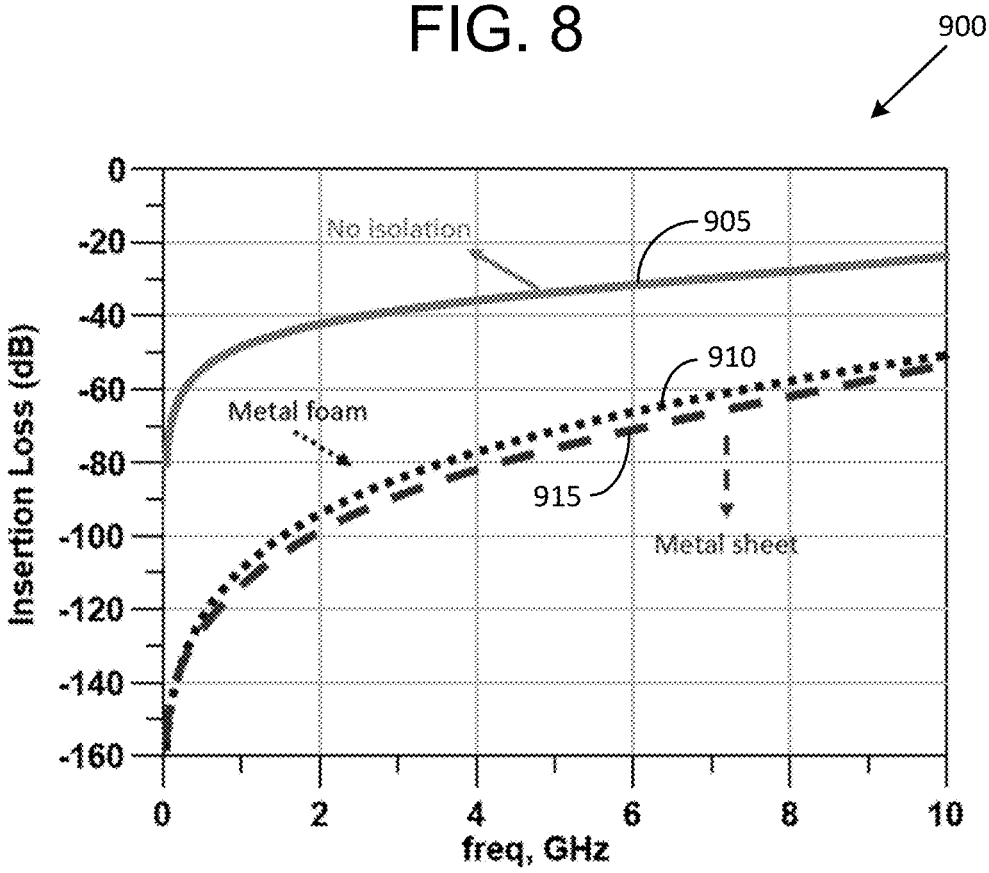
FIG. 9 shows a graph that provides insertion loss information associated with a metal foam element and an equivalent metal element.

FIG. 9 shows a graph 900 that provides insertion loss information associated with a metal foam element and an equivalent metal element, each of which is configured to operate as an isolator between two electrically small dipole antennas. The metal foam element may be used as an isolator to reduce incoming and/or outgoing radio frequency interference. More particularly, signal waves associated with the dipole antennas are reflected by the metal foam element in a manner that is substantially similar to that provided by the equivalent metal element.

Insertion loss characteristics of the metal foam element configured as an isolator is indicated by a line 910. Insertion loss characteristics of the equivalent metal element configured as an isolator is indicated by a line 915. Line 905 indicates an insertion loss characteristic between the two electrically small dipole antennas when no isolator is used.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, one skilled in the art will recognize such feature, structure, or characteristic in connection with other embodiments whether or not explicitly described.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described example embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An apparatus comprising:

an electrical device provided in a vehicle; and a metal foam element attached to the electrical device in a configuration whereby the metal foam element provides a multi-purpose functionality, the multi-purpose functionality comprising a heat dissipation functionality and an antenna functionality;

an enclosure; and one of an electronic circuit or an electronic device contained in the electrical device, the metal foam element arranged on a surface of the enclosure to dissipate heat generated by the one of the electronic circuit or the electronic device and to operate as an antenna for the one of the electronic circuit or the electronic device.

2. The apparatus of claim 1, wherein the metal foam element is configured to dissipate heat via heat conduction and heat convection through a porous structure of the metal foam element.

3. The apparatus of claim 2, wherein the electrical device includes a component that generates heat.

4. The apparatus of claim 2, wherein the electrical device is an electronic control unit of the vehicle.

5. The apparatus of claim 1, wherein the one of the electronic circuit or the electronic device comprises a wireless component and wherein the metal foam element is configured to operate as a patch antenna for the wireless component.

6. The apparatus of claim 5, wherein a size of the patch antenna is selected based on a wavelength of operation of the wireless component.

7. The apparatus of claim 5, wherein the metal foam element is configured to encase the electrical device and provide a Faraday cage functionality.

8. The apparatus of claim 1, wherein the multi-purpose functionality further comprises a radio-frequency interference shielding functionality.

9. An apparatus comprising:

an electrical device provided in a vehicle; and a metal foam element coupled to the electrical device in a configuration whereby the metal foam element provides a multi-purpose functionality, the multi-purpose functionality comprising a heat dissipation functionality to dissipate heat produced by the electrical device and an antenna functionality to electrical signals associated with the electrical device, wherein the metal foam element comprises a sheet, and wherein the electrical device includes a planar surface upon which the sheet is mounted.

10. The apparatus of claim 9, wherein the sheet is dimensioned to operate as a patch antenna, the patch antenna coupled to the electrical device.

11. The apparatus of claim 10, wherein the electrical device generates heat, and wherein the heat generated by the electrical device is dissipated through the patch antenna.

12. The apparatus of claim 9, wherein the electrical device is mounted upon a chassis of the vehicle.

13. An apparatus comprising:

a module provided in a vehicle, the module housing an electrical device; and a sheet attached to an external surface of the module, the sheet having a metal foam content that provides a multi-purpose functionality, the multi-purpose functionality comprising an antenna functionality for transmitting and/or receiving a wireless signal associated with the electrical device and a heat dissipation functionality for dissipating heat produced by the electrical device.

14. The apparatus of claim 13, wherein the sheet is electrically coupled to the electrical device and dimensioned to operate as a patch antenna.

15. The apparatus of claim 14, wherein the electrical device generates heat, and wherein the patch antenna is electrically coupled to the electrical device in a configuration whereby the heat generated by the electrical device is dissipated through the patch antenna.

16. The apparatus of claim 14, wherein the electrical device is a communications device.

17. The apparatus of claim 14, wherein the electrical device is an electronic control unit of the vehicle.

18. The apparatus of claim 13, wherein the module is mounted upon a chassis of the vehicle.

* * * * *